US005427172A

United States Patent [19]

Ekerot

[11] Patent Number: 5,427,172

[45] Date of Patent: Jun. 27, 1995

[54] METHOD AND APPARATUS FOR THE DIRECT CASTING OF METALS TO FORM ELONGATED BODIES

[76] Inventor: Sven T. Ekerot, Minervavägen 19, S-191 50 Sollentuna, Sweden

[21] Appl. No.: 816,540

[22] Filed: Dec. 30, 1991

Related U.S. Application Data

[63] Continuation of Ser. No. 469,605, filed as PCT/SE88/00558, Oct. 21, 1988, abandoned.

[30] Foreign Application Priority Data

Oct. 23, 1987 [SE] Sweden ..... 8704138

[51] Int. Cl.[6] ..... B22D 11/00

[52] U.S. Cl. ..... 164/461; 164/417; 164/419

[58] Field of Search ..... 164/417, 418, 419, 461

[56] References Cited

U.S. PATENT DOCUMENTS

| | | | |
|---|---|---|---|
| 2,310,893 | 2/1943 | Brenner | 164/461 |
| 3,568,753 | 3/1971 | Clarke | 164/461 |
| 4,726,417 | 2/1988 | Sano | 164/461 |
| 4,733,716 | 3/1988 | Tominage | 164/461 |

FOREIGN PATENT DOCUMENTS

| | | | |
|---|---|---|---|
| 46-21829 | 6/1971 | Japan | 164/461 |
| 57-106464 | 7/1982 | Japan | 164/461 |
| 451419 | 5/1968 | Switzerland | 164/461 |
| 509456 | 7/1939 | United Kingdom . | |
| 766584 | 1/1957 | United Kingdom | 164/461 |
| 839556 | 6/1960 | United Kingdom | 164/419 |
| 1174081 | 12/1969 | United Kingdom . | |
| WO8103136 | 11/1981 | WIPO . | |
| WO8704100 | 7/1987 | WIPO . | |
| WO8707192 | 12/1987 | WIPO . | |

*Primary Examiner*—P. Austin Bradley
*Assistant Examiner*—James Miner
*Attorney, Agent, or Firm*—Nies, Kurz, Bergert & Tamburro; Philip E. Kurz

[57] ABSTRACT

A method for the direct casting of metallic material, such as steel, to produce elongated bodies (2) which can form blanks having a cross-section which corresponds relatively close to the cross-section of the intended products, in which method a metal melt (1′), while at least its outermost layer remains molten, is caused to run from an outlet gate (3) in a molten-metal container (1) and is collected subsequent to solidification. The melt (1′) of molten metal which exits from the gate exits together with a metallic body (5) which has substantially the same melting point as the molten metal, this metallic body being passed through the gate (3), inserted into and moving with the molten metal and causes cooling of the molten metal (1′) progressively. The metallic body thereby entrains the molten metal at substantially the same speed as the metallic body (5) in what is termed a boundary layer. The cross-section of the inserted metallic body (5) is correlated to the cross-section of the molten metal determined by the outlet gate, so that the cooling and entraining effect of the inserted body assists in forming the desired boundary layer and in the formation of a network of solidified metal adjacent the metallic body. There is also an arrangement for carrying out the method.

8 Claims, 2 Drawing Sheets

METHOD AND APPARATUS FOR THE DIRECT CASTING OF METALS TO FORM ELONGATED BODIES

Figure 1:
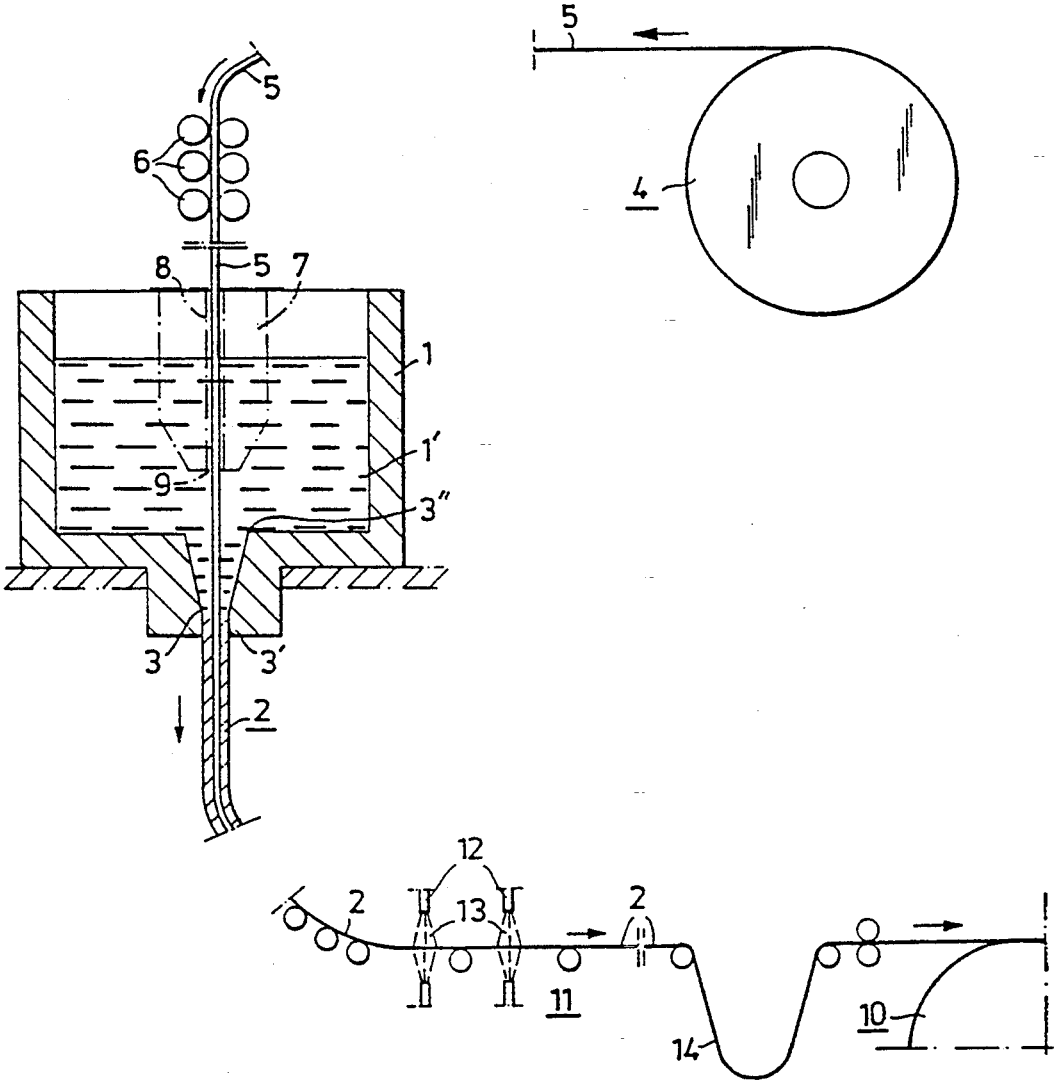

This application is a continuation of Ser. No. 469,605, filed as PCT/SE88/00558, Oct. 21, 1988 now abandoned.

The present invention relates to a method for the direct casting of metals to form elongated bodies, primarily blanks having a cross-section which corresponds relatively closely to the cross-section of the intended products, in which method molten metal is caused to run from an outlet or gate in a metal bath container and collected subsequent to solidifying.

The invention also relates to apparatus for carrying out the method.

The ability to cast steel and other metals to a dimension which corresponds closely to the cross-section of the intended product directly from a molten metal bath has obvious advantages. This would enable considerable savings to be made in respect to personnel costs and also to costs relating to, inter alia, energy, working materials and investments.

Considerable difficulties are encountered in the performance of such direct casting processes, however. A high teeming or pouring rate is required, since the cross-section is small while, at the same time, the demand for quality surfaces increases, since the casting, lies relatively close to the final dimension.

The development from the casting of ingots to continuous casting techniques can be said to constitute a step in the direction towards direct casting processes. Continuous casting processes are also known for casting shapes of small dimensions. These known processes have not been used in production to any great extent, due to a slow production rate and the poor quality of the surface of the castings produced. Among other things, the slow rate of productivity experienced with continuous casting processes is due to the fact that a thin, solid layer or coating must have time to form and contain the molten metal.

It is conceivable that a high production rate can be achieved in the case of processes with which it is not necessary for a thin, solid layer to form prior to the material, such as steel, leaving the pouring gate from which casting shall take place. Such a process would also enable acceptable surfaces to be obtained. Molten material, however, has a tendency to form droplets through inhomogenous flow and can even break-up entirely into droplets. Consequently, there is a need to stabilize the exiting material with regard to its shape and also to cool the melt. The present invention relates to a method and to an apparatus which offer a solution to the problem of providing an industrially applicable direct casting process for the casting of elongated bodies which are relatively small in cross-section.

Accordingly, the present invention relates to a method for the direct casting of metallic materials, such as steel, into elongated bodies, primarily in the form of blanks whose cross-sections correspond relatively closely to the cross-sections of the intended products, in which method a melt of the metal concerned is caused to run through a container gate means and collected subsequent to solidification. The method is particularly characterized in that the molten metal is caused to exit from the gate together with a metallic body whose melting point is substantially the same as that of the metal melt; in that the body is passed through the gate while contained in and moving with the molten metal, therewith to cause progressive cooling of the molten metal and to therewith entrain the molten metal in a so-called boundary layer at essentially the same speed as said body, the cross-section of the body accompanying said molten metal being adapted to the cross-section of the molten metal determined by the gate, so that the cooling and entraining effect exerted by the body will assist in obtaining the desired boundary layer and the formation of a solidified metal network.

The present invention also relates to an arrangement for the direct casting of metallic materials, such as steel, into elongated bodies which form primarily blanks whose respective cross-sections correspond relatively closely to the cross-sections of the intended products, said arrangement comprising a molten-metal container provided with an outlet gate means-through which the molten metal is intended to run, and an uncoiling arrangement which carries a cooling body whose melting point is essentially the same as that of the molten metal and from which cooling arrangement the cooling body is intended to run through the outlet gate and co-act with the molten metal exiting therefrom, and further comprises a coiling arrangement for coiling of the cast body. The arrangement is particularly characterized in that the cross-section of the outlet gate is substantially fully identical with the desired cross-section of the cast body, and in that the cross-section of the cooling body is preferably 9–30% of the total cross-section of the cast body.

The use of a stabilizing body in the direct casting of wire rod is known to the art, although the technique applied in this respect differs essentially from the present invention.

Figure 2:
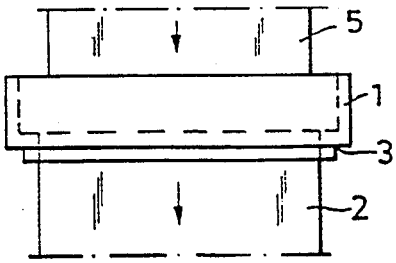
Figure 3:
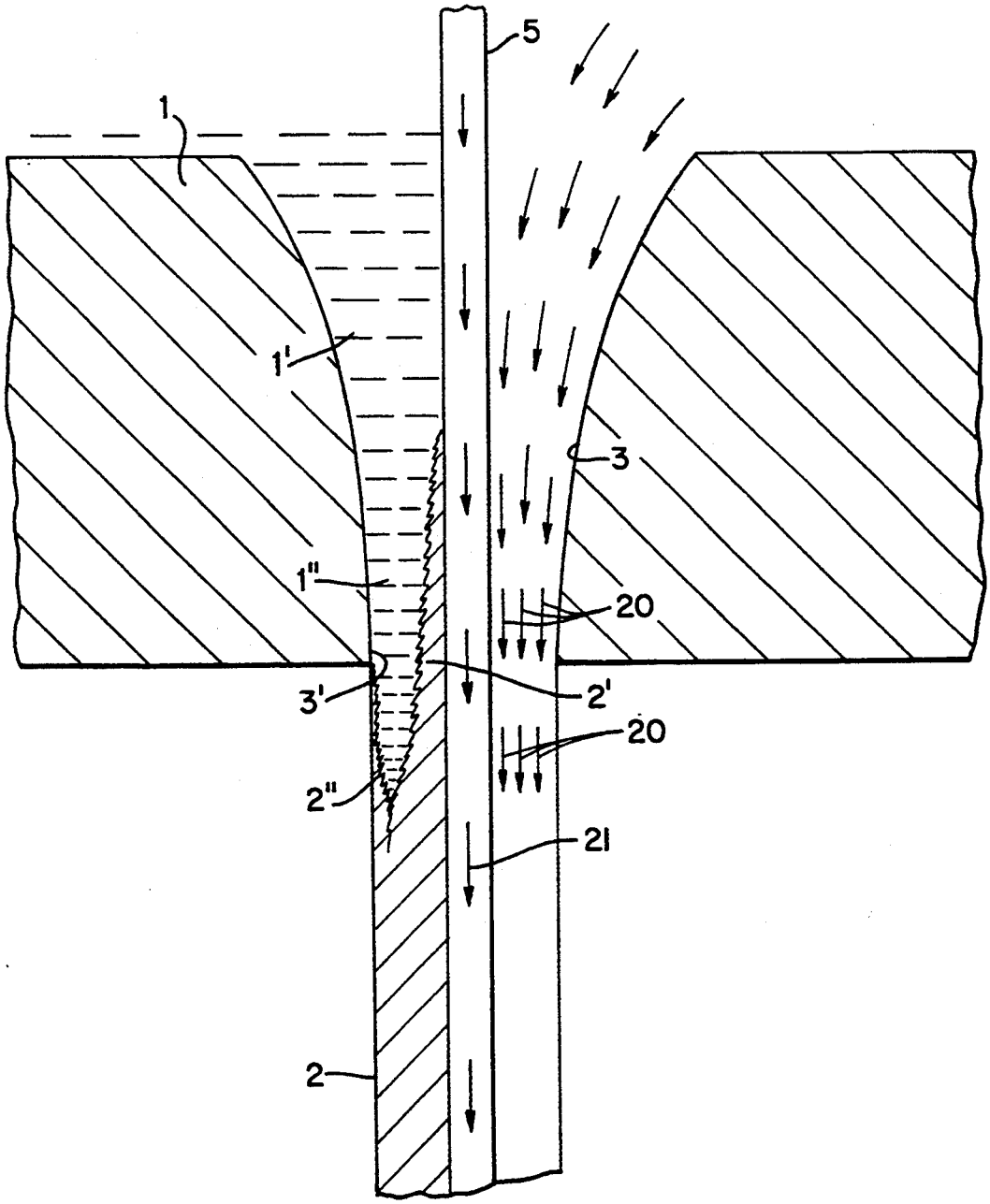

The invention will now be described in more detail with reference to exemplifying embodiments thereof and also with reference to the accompanying drawing, in which FIG. 1 illustrates schematically a first embodiment of an arrangement for direct casting in accordance with the invention;

FIG. 2 illustrates schematically the casting of a body of substantially rectangular cross-section as seen in the direction of body thickness; and FIG. 3 is an enlarged detail section of the outlet of a molten metal container showing the state of the material of the direct cast body as it exits the gate outlet.

The arrangement illustrated in FIG. 1 includes a container 1 which contains a bath 1' of molten metal material, such as steel, which is intended for the direct casting of elongated bodies or castings 2 which form primarily blanks whose cross-sections relatively closely correspond to the cross-sections of the intended products. The container 1 incorporates an outlet gate 3 which is preferably located in the bottom of the container and through which the molten metal is intended to run, in the manner illustrated in FIG. 1. The outlet gate 3 has an outlet orifice 3' which defines the actual cross-sectional shape of the gate and consequently all reference here to the cross-sectional shape of the mate in fact applies to the cross-sectional shape of the gate orifice 3', which constitutes essentially the smallest cross-section.

The reference 4 identifies an uncoiling arrangement which is drawn to a scale different to the container 1 etc. and which carries an elongated cooling body 5 which is intended to run from the uncoiling arrangement and, preferably via feed rollers 6 or the like, to extend down through the bath and pass out through the gate for co-action with the molten metal exiting through said gate, said body 5, which is preferably metallic, being inserted into and moving with the molten metal, therewith cooling and stabilizing the same.

According to a preferred embodiment, the cooling body 5 is intended to be passed down into the melt through nozzle 7 which includes a slot or channel 8 and the bottom orifice 9 of which is held at a distance of about 10–30 cm from the interior orifice 3'' of the gate 3. In this respect the height of the bath in the container will be preferably greater than said distance.

According to one embodiment, the gate 3 has a substantially rectangular cross-section 3' for casting a body of substantially rectangular cross-section. The shape produced has a thickness of about 1–10 mm and a width of about 5–1000 mm. In the case of this embodiment, the cooling body 5 has substantially a rectangular cross-sectional shape and the cross-section of the body 5 will preferably correspond to about 9–30% of the total cross-section of the cast body or shape 2.

According to another embodiment, the gate 3 has a substantially elliptical, substantially circular or like cross-sectional shape, for casting a body of corresponding cross-sectional shape, said shape, in this case having a major axis which is 3–50 mm, and a minor axis which is 2–10 mm. As with the above described rectangular cross-section, the cooling body 5 will preferably correspond to about 9–30% of the total cross-section of the cast body.

The exemplifying embodiment illustrated in FIG. 1 also includes a coiling arrangement 10 intended for coiling up the cast body 2. The coiling arrangement 10 is preceded by a cooling bed 11 or the like onto which the cast body is intended to run and, preferably, be brought into contact with a cooling medium 13 by means of cooling devices 12. The cooling devices and the cooling medium of the FIG. 1 embodiment comprise spray nozzles 12 for spraying, e.g., water or steam onto the casting. The coiling-arrangement and cooling bed are shown in a different scale to the scale in which the container 1 etc. are shown. A buffer loop 14 is formed in order to accommodate accumulations resulting from variations in speed.

FIG. 2 illustrates the casting of a body of rectangular cross-section, a substantially strip-like body, said body 2 being shown in the direction of its thickness. In this case, the outlet gate 3 includes a substantially slot-like outlet orifice, and the nozzle 7, in the present case, also includes a relatively thin slot through which a body 5 can pass.

It is preferred, in certain cases, to provide means (not shown) for heating the gate 3 to a temperature of up to about 200° C. above the bath temperature at which solidification begins, the so-called liquidus temperature, and for maintaining the temperature. Of course, heating can be effected in a number of known ways.

In other cases, it is preferred to provide means (not shown) for cooling the gate to a temperature of up to about 350° C. beneath the liquidus temperature and for maintaining the temperature in question. This cooling process can be effected in a number of known ways.

The inventive method and the manner of operation of the inventive arrangement will be evident in all essentials from the aforegoing.

With reference to FIG. 3, the cross-section of the cooling bodys is adapted in relation to the exiting molten metal, so that the cooling effect exerted by the cooling body 2 assists in creating a network of so-called dentriters of solidified material in the molten metal, such that the viscosity of the dentrite-containing melt will ensure that the shape imparted to the molten metal through the action of the gate will remain essentially subsequent to the molten metal leaving the gate. More explicitly, the cooling body is caused to cool the molten metal 1' progressively and, at the same time, entrain the molten metal so that said metal will move at substantially the same speed (see the equal lengths of flow arrows 20 and 21 at the right hand side of FIG. 3) as the body 5 in a so-called boundary layer 1, the cross-section of the cooling body 5 being adapted to the cross-section and geometry of the molten metal defined by the gate, so that the entraining and cooling effect of the cooling body inserted into the gate assists in forming the desired boundary layer 1 and in the formation of a network 2' of solidified metal. Laminar flow phenomena occur during the formation of the boundary layer.

The metal is still to a large extent in a liquid state when it leaves the gate, and particularly the outer part of the liquid, which enables the casting process to be carried out at a high casting rate.

As a result of the formation of the boundary layer and the commencement of solidification, the exiting melt will retain the shape imparted thereto in the gate after exiting therefrom, until a thin external shell or skin 2'' of solidified metal has been formed by cooling resulting from radiation and convection.

The actual casting process may be carried out by introducing the cooling body into the molten bath located in a foundry box having a bath height of some decimeters. The cooling body is passed out through the gate surrounded by molten metal. The rate at which the casting is produced is determined to a large extent by the speed of the cooling body.

Three examples of manufacture in accordance with the invention are given below.

EXAMPLE 1

Stainless steel SIS 2333 was east with a cooling body of essentially the same material as in the original eases, The dimensions of the gate outlet were about 3 mm in the thickness direction and about 32 mm wide, and the dimension of the cooling body was, correspondingly, about 1.2 mm and about 30.4 ram. The casting temperature was about 1480° C. and the casting rate about 0.8 m/s. The bath height was about 15–20 cm.

EXAMPLE 2

Low carbon steel having a carbon content of 0.10% was cast with a cooling body of substantially the same material. The dimensions of the gate outlet were 3.5 mm in the thickness direction and about 20 mm in width, and the cooling body was about 1.6 mm thick and about 18.2 mm wide. The casting temperature was about 1540° C., and the casting rate was about 1.5 m per second. The bath height was about 15–20 cm.

EXAMPLE 3

Stainless steel, SIS 2343, was cast with a cooling body of carbon steel having a carbon content of about 0.08%. The dimensions of the gate outlet were about 3 mm in the thickness direction and about 90 mm in the width direction, and the cooling body was about 1.1 mm thick and about 88.7 mm wide. The casting temperature was about 1465° C. and the casting rate about 0.5–2 meters per second. The bath height varied from 15 cm to 5 cm.

It will be evident from the aforegoing that the method and the arrangement according to the invention enable a well-controlled direct casting process to be carried out in which the shape of the cast body can be carefully controlled despite the presence of melt. The desire for a high casting rate is satisfied, because molten metal is in contact with the gate instead of a stationary shell, as in the case of continuous casting processes. The resultant problem of maintaining the shape of the exiting metal until a shell has been formed has been solved in the aforedescribed manner.

The invention has been described in the aforegoing with reference to a number of exemplifying embodiments thereof. It will understood, however, that other embodiments are possible and that minor modifications can be made without departing from the inventive concept.

For example, the shapes produced may differ from the aforesaid purely rectangular, elliptical and circular cross-sectional shapes.

Furthermore, many different combinations of metallic materials are conceivable in respect of the combination molten metal bath and cooling body.

With regard to controlling the temperature with respect to the outlet gate, this can be effected with the aid of microwaves, by means of induction, by means of radiation or by resistance heating. Combinations of these heating methods are also conceivable.

In general, wide variations are conceivable with regard to casting conditions.

For example, higher casting rates and widths can be used than those given in the three examples above.

A plurality of material combinations are also conceivable. For example, the cooling body may consist essentially of the same material as the molten bath or of a material different to said bath material.

Consequently, the invention shall not be considered to be limited to the aforedescribed embodiments, since variations and modifications can be made within the scope of the following claims.

I claim:

1. A method for the direct casting of metallic material to produce elongated bodies, from which blanks are obtained, having a cross-section which corresponds relatively closely to the cross-section of an intended product to be made from the blanks, comprising the steps of causing a melt of said metallic material to run from an outlet gate in a molten-metal container, and to be collected subsequent to solidifying, and together with the molten metal caused to exit from the outlet gate, causing a metallic body, which has substantially the same melting point as the molten metallic material, to be passed through the gate while located in the molten metal, causing progressive cooling and stabilizing of the molten metallic material by said metallic body while both are passing together through and from the outlet gate, the improvement of causing the form, which the molten metallic material is given by the cross-section shape of the outlet gate (3), to be substantially maintained by adapting the cross-section of the metallic body, which is a cooling body, to a shape similar to but smaller than the cross-section shade of the outlet gate and of the molten metallic material flowing therethrough, whereby the cooling effect of the metallic cooling body (5) at the boundary layer between said cooling body and said molten metal surrounding the cooling body causes the formation of a network of solidified metallic material from the molten metallic material surrounding the metallic body and, in the boundary layer of the molten metallic material passing from and adjacent the outlet gate, causing a boundary layer laminar flow phenomena to occur in the cast elongated body during formation of the boundary layer adjacent the outlet gate while the outer layer of the elongated body, which contacts and is caused to flow past the outlet gate at substantially the same speed as the speed of said metallic body as the elongated body passes through the outlet gate, remains molten at least until it has passed the outlet gate; said method further comprising the steps of: cooling the outlet gate (3) to a temperature of up to about 350° C. beneath the temperature at which solidification of the molten metallic material commences, the so-called liquidus temperature, and maintaining the outlet gate at said temperature.

2. A method for the direct casting of metallic material to produce elongated bodies, from which blanks are obtained, having a cross-section which corresponds relatively closely to the cross-section of an intended product to be made from the blanks, comprising the steps of causing a melt of said metallic material to run from an outlet gate in a molten-metal container, and to be collected subsequent to solidifying, and together with the molten metal caused to exit from the outlet gate, causing a metallic body, which has substantially the same melting point as the molten metallic material, to be passed through the gate while located in the molten metal, causing progressive cooling and stabilizing of the molten metallic material by said metallic body while both are passing together through and from the outlet gate, the improvement of causing the form, which the molten metallic material is given by the cross-section shape of the outlet gate (3), to be substantially maintained by adapting the cross-section of the metallic body, which is a cooling body, to a shape similar to but smaller than the cross-section shape of the outlet gate and of the molten metallic material flowing therethrough, whereby the cooling effect of the metallic cooling body (5) at the boundary layer between said cooling body and said molten metal surrounding the cooling body causes the formation of a network of solidified metallic material from the molten metallic material surrounding the metallic body and, in the boundary layer of the molten metallic material passing from and adjacent the outlet gate, causing a boundary layer laminar flow phenomena to occur in the cast elongated body during formation of the boundary layer adjacent the outlet gate while the outer layer of the elongated body, which contacts and is caused to flow past the outlet gate at substantially the same speed as the speed of said metallic body as the elongated body passes through the outlet gate, remains molten at least until it has passed the outlet gate; said method further comprising the steps of heating the outlet gate (3) to, and maintaining the outlet gate at a temperature of up to about 200° C. above the liquidus temperature of the molten metallic material.

3. A method for the direct casting of metallic material to produce elongated bodies, from which blanks are obtained, having a cross-section which corresponds relatively closely to the cross-section of an intended product to be made from the blanks, comprising the steps of causing a melt of said metallic material to run from an outlet gate in a molten-metal container, and to be collected subsequent to solidifying, and together with the molten metal caused to exit from the outlet gate, causing a metallic body, which has substantially the same melting point as the molten metallic material, to be passed through the gate while located in the molten metal, causing progressive cooling and stabilizing of the molten metallic material by said metallic body while both are passing together through and from the outlet gate, the improvement of causing the form, which the molten metallic material is given by the cross-section shape of the outlet gate (3), to be substantially maintained by adapting the cross-section of the metallic body, which is a cooling body, to a shape similar to but smaller than the cross-section shape of the outlet gate and of tile molten metallic material flowing therethrough, whereby the cooling effect of the metallic cooling body (5) at the boundary layer between said cooling body and said molten metal surrounding the cooling body causes the formation of a network of solidified metallic material from the molten metallic material surrounding the metallic body and, in the boundary layer of the molten metallic material passing from and adjacent the outlet gate, causing a boundary layer laminar flow phenomena to occur in the cast elongated body during formation of the boundary layer adjacent the outlet gate while the outer layer of the elongated body, which contacts and is caused to flow past the outlet gate at substantially the same speed as the speed of said metallic body as the elongated body passes through the outlet gate, remains molten at least until it has passed the outlet gate; said method further comprising: use of an outlet gate (3) of substantially rectangular cross-section to cast a body (2) of that same substantially rectangular cross-section and using a said cooling metallic body (5) having a similar substantially rectangular cross-section whereby the body (2) cast will have a minor dimension of about 1–10 mm. and a major dimension of about 5–1000 mm.

4. A method for the direct casting of metallic material to produce elongated bodies, from which blanks are obtained, having a cross-section which corresponds relatively closely to the cross-section of an intended product to be made from the blanks, comprising the steps of causing a melt of said metallic material to run from an outlet gate in a molten-metal container, and to be collected subsequent to solidifying, and together with the molten metal caused to exit from the outlet gate, causing a metallic body, which has substantially the same melting point as the molten metallic material, to be passed through the gate while located in the molten metal, causing progressive cooling and stabilizing of the molten metallic material by said metallic body while both are passing together through and from the outlet gate, the improvement of causing the form, which the molten metallic material is given by the cross-section shape of the outlet gate (3), to be substantially maintained by adapting the cross-section of the metallic body, which is a cooling body, to a shape similar to but smaller than the cross-section shape of the outlet gate and of the molten metallic material flowing therethrough, whereby the cooling effect of the metallic cooling body (5) at the boundary layer between said cooling body and said molten metal surrounding the cooling body causes the formation of a network of solidified metallic material from the molten metallic material surrounding the metallic body and, in the boundary layer of the molten metallic material passing from and adjacent the outlet gate, causing a boundary layer laminar flow phenomena to occur in the cast elongated body during formation of the boundary layer adjacent the outlet gate while the outer layer of the elongated body, which contacts and is caused to flow past the outlet gate at substantially the same speed as the speed of said metallic body as the elongated body passes through the outlet gate, remains molten at least until it has passed the outlet gate; said method further comprising: casting a body (2) of a desired geometric cross-section shape by using an outlet gate (3) of the desired geometric cross-section shape, using a said cooling metallic body of a similar but smaller cross-section shape than said desired geometric cross-section shape and the east body (2) cross-section shape having a major axis the dimension of which is 3–50 mm. and a minor axis the dimension of which is 2–10 mm.

5. A method as defined in claim 4, wherein said desired geometric cross-section shape is selected from a group of cross-section shapes consisting of substantially rectangular, substantially elliptical and substantially circular.

6. A method as defined in claim 5, further comprising using a cooling body with a cross-section shape similar to the selected cross-section shape and having a cross-section area which is approximately within the range of from 9–30% of the total cross-section area of the cast body.

7. A method for the direct casting of metallic material to produce elongated bodies, from which blanks are obtained, having a cross-section which corresponds relatively closely to the cross-section of an intended product to be made from the blanks, comprising the steps of causing a melt of said metallic material to run from an outlet gate in a molten-metal container, and to be collected subsequent to solidifying, and together with the molten metal caused to exit from the outlet gate, causing a metallic body, which has substantially the same melting point as the molten metallic material, to be passed through the gate while located in the molten metal, causing progressive cooling and stabilizing of the molten metallic material by said metallic body while both are passing together through and from the outlet gate, the improvement of causing the form, which the molten metallic material is given by the cross-section shape of the outlet gate (3), to be substantially maintained by adapting the cross-section of the metallic body, which is a cooling body, to a shape similar to but smaller than the cross-section shape of the outlet gate and of the molten metallic material flowing therethrough, whereby the cooling effect of the metallic cooling body (5) at the boundary layer between said cooling body and said molten metal surrounding the cooling body causes the formation of a network of solidified metallic material from the molten metallic material surrounding the metallic body and, in the boundary layer of the molten metallic material passing from and adjacent the outlet gate, causing a boundary layer laminar flow phenomena to occur in the east elongated body during formation of the boundary layer adjacent the outlet gate while the outer layer of the elongated body, which contacts and is caused to flow past the outlet gate at substantially the same speed as the speed of said metallic body as the elongated body passes through the outlet gate, remains molten at least until it has passed the outlet gate; said method further comprising using a said metallic cooling body, the cross-section area of which is approximately within the range of 9–30% of the total cross-section area of the cast body (2).

8. A method for the direct casting of metallic material to produce elongated bodies, from which blanks are obtained, having a cross-section which corresponds relatively closely to the cross-section of an intended product to be made from the blanks, comprising the steps of causing a melt of said metallic material to run from an outlet gate in a molten-metal container, and to be collected subsequent to solidifying, and together with the molten metal caused to exit from the outlet gate, causing a metallic body, which has substantially the same melting point as the molten metallic material, to be passed through the gate while located in the molten metal, causing progressive cooling and stabilizing of the molten metallic material by said metallic body while both are passing together through and from the outlet gate, the improvement of causing the form, which the molten metallic material is given by the cross-section shape of the outlet gate (3), to be substantially maintained by adapting the cross-section of the metallic body, which is a cooling body, to a shape similar to but smaller than the cross-section shape of the outlet gate and of the molten metallic material flowing therethrough, whereby the cooling effect of the metallic cooling body (5) at the boundary layer between said cooling body and said molten metal surrounding the cooling body causes the formation of a network of solidified metallic material from the molten metallic material surrounding the metallic body and, in the boundary layer of the molten metallic material passing from and adjacent the outlet gate, causing a boundary layer laminar flow phenomena to occur in the cast elongated body during formation of the boundary layer adjacent the outlet gate while the outer layer of the elongated body, which contacts and is caused to flow past the outlet gate at substantially the same speed as the speed of said metallic body as the elongated body passes through the outlet gate, remains molten at least until it has passed the outlet gate; said method further comprising the steps of introducing the metallic cooling body (5) down into the molten metallic material (1') through a nozzle (7) whose bottom orifice (9) is located at a desired first distance dimension from the internal gate orifice (3'') located in the container (1), and providing the height dimension of the molten bath greater than said first distance dimension, said desired first distance dimension being selected from a range of distance from 10–30 cm. and said height dimension selected to be within a range of distance from 15–45 cm., but greater than said selected first distance dimension.

* * * * *